US010376908B2

(12) United States Patent
Davey et al.

(10) Patent No.: US 10,376,908 B2
(45) Date of Patent: Aug. 13, 2019

(54) SYSTEM OF A SPECIAL VOLUME CONTROL MANIFOLD, CONTAINMENT CASE AND EASILY CHANGEABLE SOLUTION CONTAINERS FOR CARPET CLEANING AND OTHER SOLUTION NEEDS

(71) Applicant: Davey Investments, INC, Pendleton, IN (US)

(72) Inventors: Chris Davey, Pendleton, IN (US); Laura Davey, Pendleton, IN (US)

( * ) Notice: Subject to any disclaimer, the term of this patent is extended or adjusted under 35 U.S.C. 154(b) by 0 days.

(21) Appl. No.: 14/623,189

(22) Filed: Feb. 16, 2015

(65) Prior Publication Data

US 2015/0343466 A1 Dec. 3, 2015

Related U.S. Application Data

(60) Provisional application No. 62/004,368, filed on May 29, 2014.

(51) Int. Cl.

| | |
|---|---|
| ***B05B 7/24*** | (2006.01) |
| ***A47L 11/40*** | (2006.01) |
| ***A47L 11/34*** | (2006.01) |
| ***B05B 12/14*** | (2006.01) |

(52) U.S. Cl.

CPC ..... *B05B 7/2472* (2013.01); *A47L 11/34* (2013.01); *A47L 11/4083* (2013.01); *A47L 11/4088* (2013.01); *B05B 7/2443* (2013.01); *B05B 12/1418* (2013.01)

(58) Field of Classification Search

CPC . B05B 7/2472; B05B 7/2443; B05B 12/1418; A47L 11/4083; A47L 11/4088; A47L 11/34

USPC ..... 239/72, 127, 307, 318, 525, 526, 428, 239/434; 222/145.6

See application file for complete search history.

(56) References Cited

U.S. PATENT DOCUMENTS

| | | | | |
|---|---|---|---|---|
| 3,298,611 A | | 1/1967 | Marrafino et al. | |
| 4,019,653 A | | 4/1977 | Scherer et al. | |
| 4,176,672 A | | 12/1979 | Borberg | |
| 4,397,422 A | * | 8/1983 | Gwyn | B05B 7/30 222/136 |
| 4,440,314 A | | 4/1984 | Vetter et al. | |
| 4,595,127 A | | 6/1986 | Stoody | |

(Continued)

*Primary Examiner* — Alexander M Valvis
*Assistant Examiner* — Qingzhang Zhou
(74) *Attorney, Agent, or Firm* — John D Ritchison; Ritchison Law Offices, PC

(57) ABSTRACT

A system of a special volume control manifold, containment case and changeable multi-pack solution containers for carpet cleaning and other solution needs. It is portable and relates commercial-grade mixers and a hand-carried spray wand that connects directly to a pressure system having a diluent such as water. The additives are controlled at a manifold header for precise dispersal to the sprayer wand and nozzle. The proportional flow system is made of the control manifold, a hose to each of the solution containers, a control valve for each solution container, a wand with a control valve, nozzle and means to connect an mixed solution hose, and the mixed solution hose between the wand and the manifold. This configuration facilitates the system attachment to a pressured diluent and additive solution containers to provide controlled mixing of the diluent and additive solution which is then transferred to the sprayer wand.

16 Claims, 8 Drawing Sheets

(56) References Cited

U.S. PATENT DOCUMENTS

| | | | | |
|---|---|---|---|---|
| 4,988,017 | A | 1/1991 | Schrader et al. | |
| 5,381,962 | A * | 1/1995 | Teague | B05B 12/00 239/525 |
| 2005/0051577 | A1* | 3/2005 | Loeb | B01F 5/0077 222/145.6 |
| 2011/0192433 | A1* | 8/2011 | Harris | B01F 3/0865 134/57 R |
| 2012/0141683 | A1* | 6/2012 | Larson | B05B 7/2408 427/372.2 |
| 2013/0186977 | A1* | 7/2013 | Fornaro | B05B 1/30 239/127 |

* cited by examiner

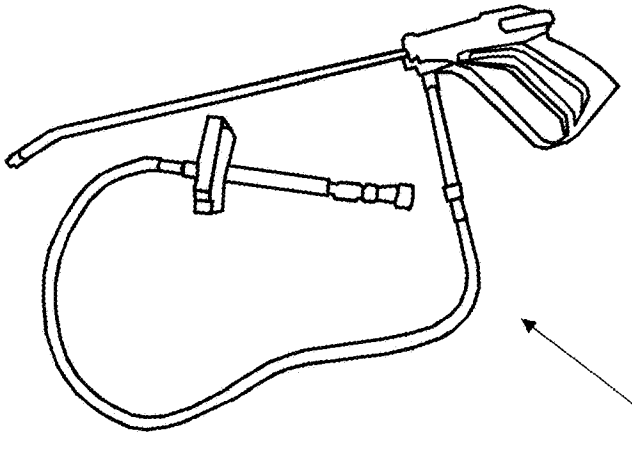
Fig. 1 A
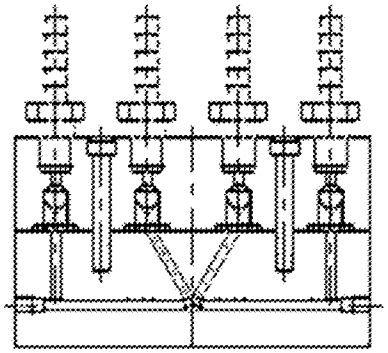
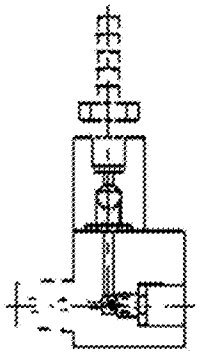
Fig. 1 B
Fig. 1 C
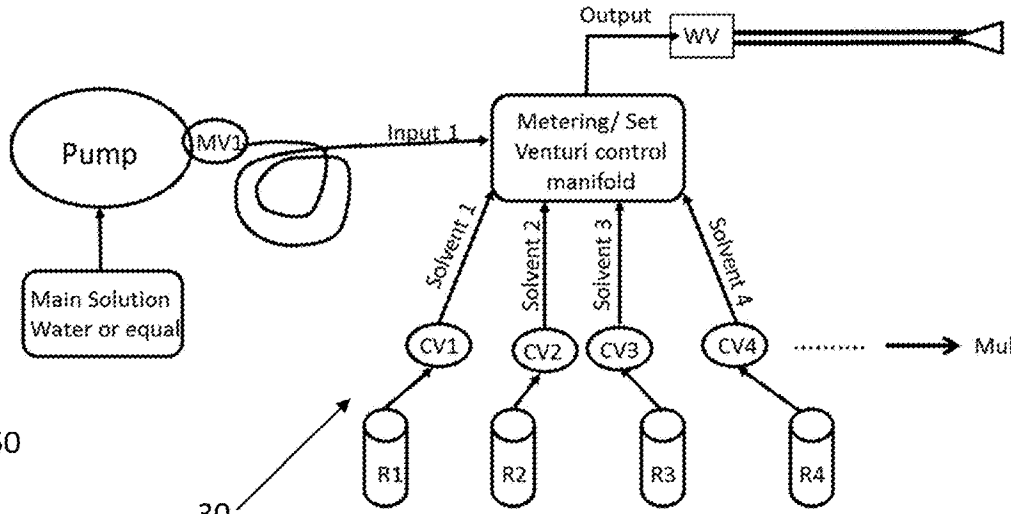
Fig. 1 D

Section AA

A
A
50
51
52
53
53A
54
54A
55
56
57
58
43
51T
52U
5152I

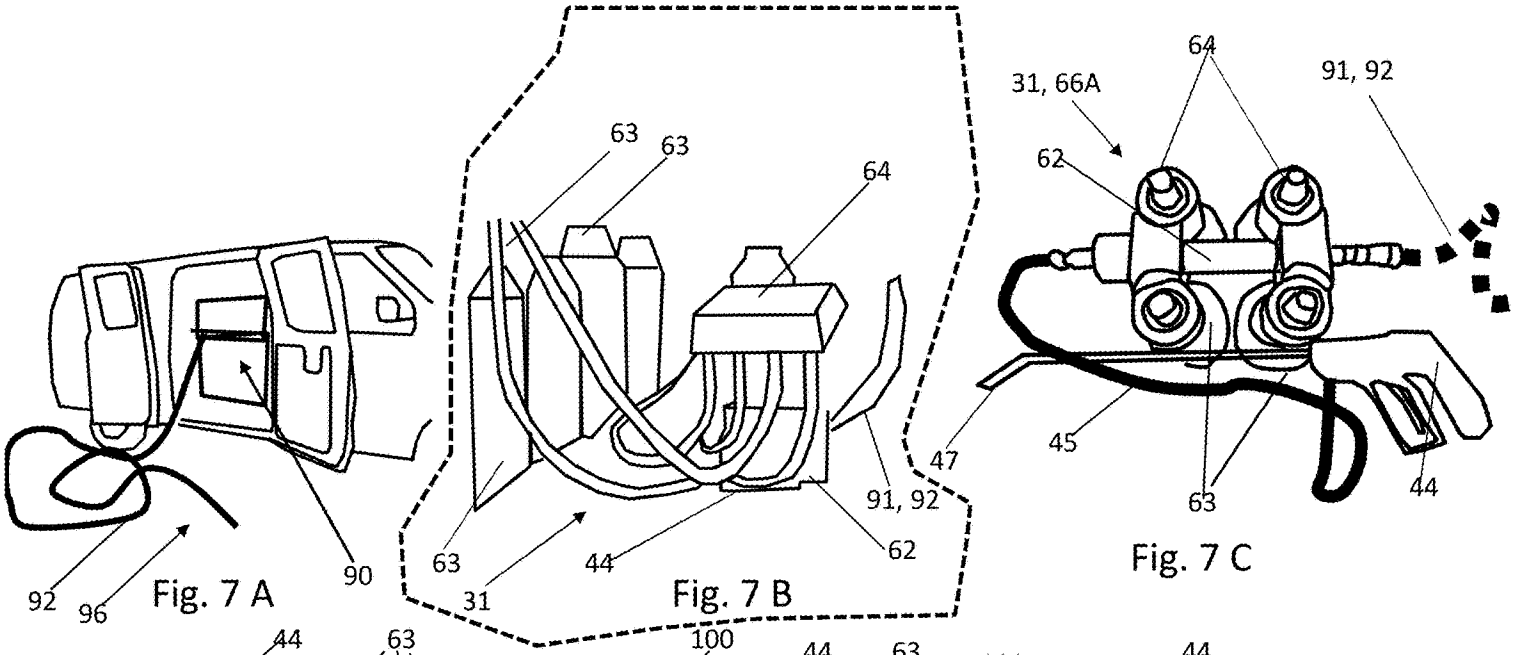
Fig. 7 A
Fig. 7 B
Fig. 7 C
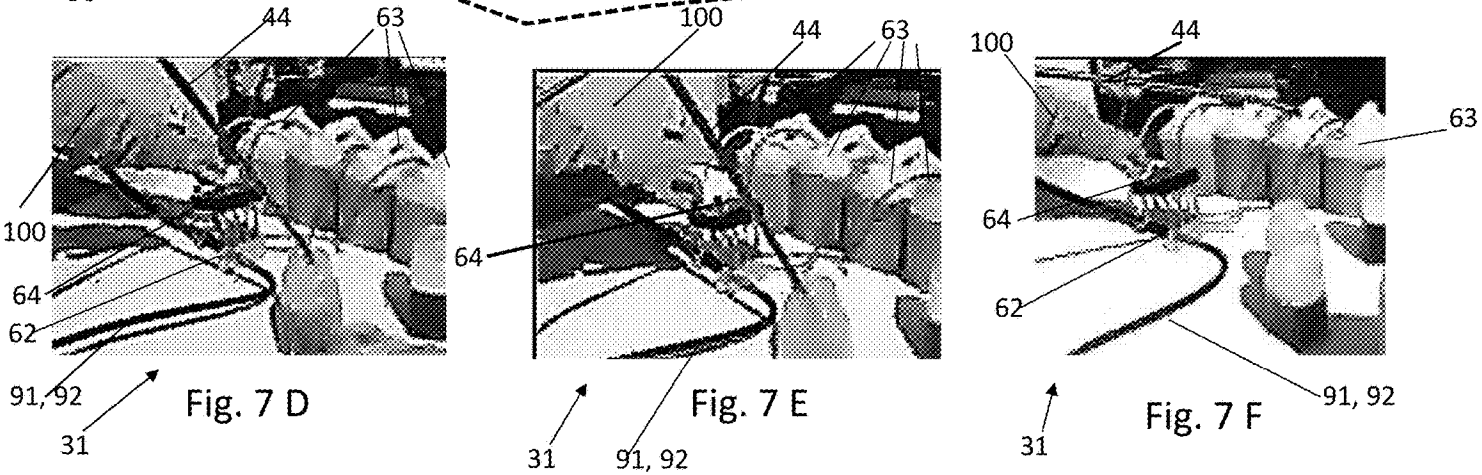
Fig. 7 D
Fig. 7 E
Fig. 7 F

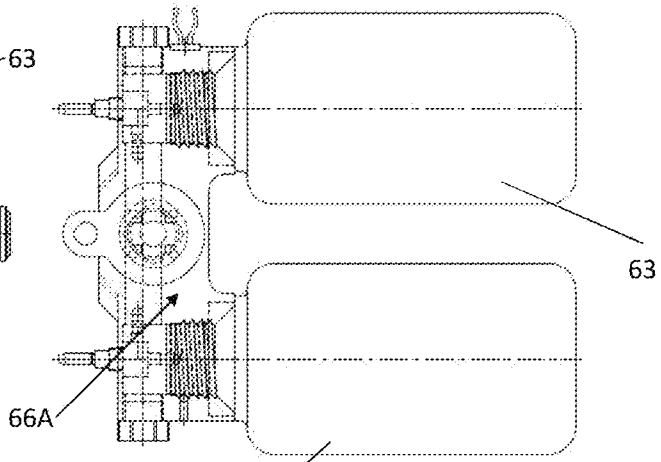
Fig. 8 B Side
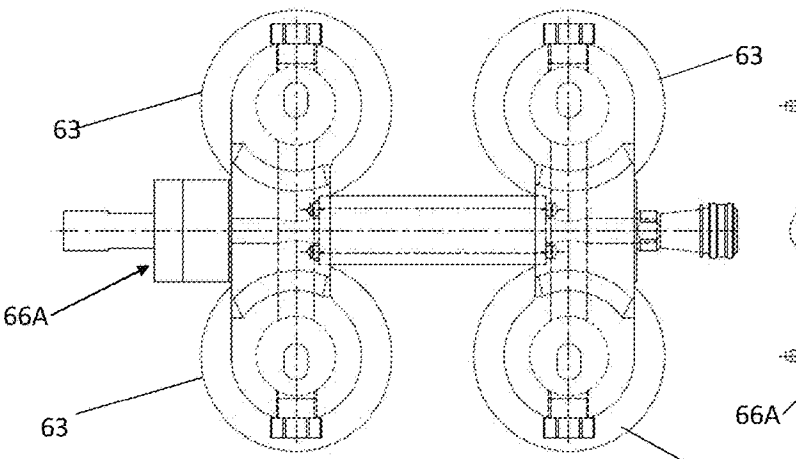
Fig. 8 A Top
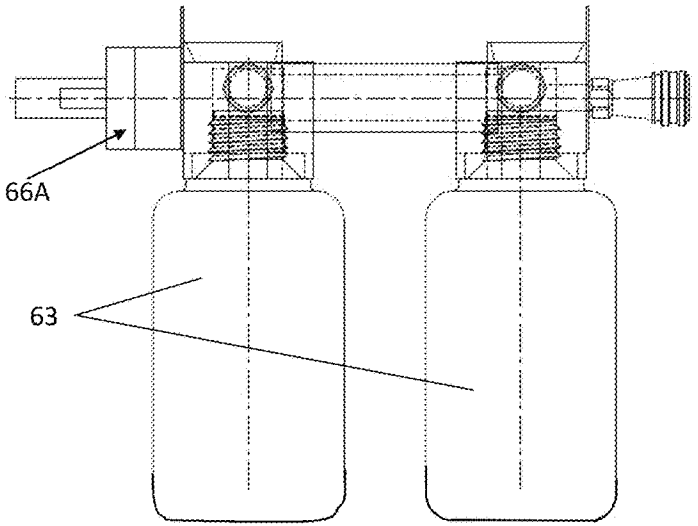
Fig. 8 C End

SYSTEM OF A SPECIAL VOLUME CONTROL MANIFOLD, CONTAINMENT CASE AND EASILY CHANGEABLE SOLUTION CONTAINERS FOR CARPET CLEANING AND OTHER SOLUTION NEEDS

CROSS-REFERENCE TO RELATED APPLICATIONS

This application claims the benefit of Provisional Patent Application Ser. No. 62/004,368 filed May 29, 2014, by Laura and Chris Davey and entitled "System of a special volume control manifold, containment case and easily changeable solution containers for carpet cleaning and other solution needs".

FIELD OF INVENTION

This invention relates to a portable system of special volume control manifold, containment case and easily changeable solution containers for carpet cleaning and other solution needs. This system relates particularly to portable commercial-grade mixer and sprayers and, more particularly, to a portable multi-pack additive and solutions for spraying through a hand-carried spray wand any of a variety of different chemicals and additives from modular containers seated in a portable container. The system is connected directly to a pressure system with a base or diluent such as water (or other solutions, paints, etc.). The additives are controlled at a manifold header for precisely controlled dispersal to the sprayer wand and nozzle.

The system of special volume control manifold, containment case and easily changeable solution containers for carpet cleaning and other solution needs. The present invention relates to chemical dispensation devices and, more specifically, to a device for selectively dispensing ones of a variety of liquid-based, foam, and/or gel-type chemical compositions with a pressurized diluent/base such as temperature controlled water. This invention is directed to a method and apparatus for continuously combining two, or more, distinct liquids, while maintaining substantially fixed relative proportions, over a range of flow rates.

FEDERALLY SPONSORED RESEARCH

None.

SEQUENCE LISTING OR PROGRAM

None.

BACKGROUND

Field of Invention and Prior Art

This section is not Applicable to Provisional Applications. However, as far as known, there are no system of special volume control manifold, containment case and easily changeable solution containers for carpet cleaning and other solution needs or the like. It is believed that this product is unique in its design and technologies.

Problem Solved

The present invention relates to chemical dispensation devices and, more specifically, to a device for selectively dispensing ones of a variety of liquid-based, foam, and/or gel-type chemical compositions with a pressurized diluent/base such as temperature controlled water. In typical households, residences, and other domestic dwellings, as well as within commercial and business buildings, many chemical cleaning agents are used in performing numerous tasks. Common home cleaning, freshening, carpet cleaning or various soils and stains or other maintenance tasks need this new system. In a given area within a household or commercial building, for example, within a single room, very often more than one cleaning agent can be used during a single cleaning session. Accordingly, users of chemical cleaning agents occasionally must tote or carry around multiple containers of different chemical cleaning agents. In the alternative to transporting multiple chemical cleaning agents, the user is required to make multiple trips between the pieces being cleaned and, for example, the area where the cleaning agents are stored to exchange previously used agents for those which will be used subsequently.

While some cleaning tasks are performed at or near the location where chemical cleaning agents are stored, the user is still required to handle numerous individual products. As one example, many individuals keep or store various cleaning supplies within bathrooms, and bathroom cleaning typically requires the use of numerous chemical cleaning agents. Although such cleaning supplies might be stored within the bathroom, the user is still required to handle, use, manipulate, and switch between the various individual products. Therefore, it is desirable to develop a dispensing device that can selectively dispense more than one cleaning agent, enabling a user to employ a single device for dispensing and using a variety of cleaning agents. Therefore, it is also desirable to provide a dispensing device which includes multiple, replaceable, concentrated cleaning chemistries for use with a single diluent dispenser with multi-venturi controls on each sources for the solvents included.

Prior Art

There are a wide variety of sprayers available for application of liquid fertilizers and pest control solutions, including backpack sprayers, hand sprayers, and truck-mounted spray tank systems. The simplest sprayers are designed for consumer use and typically comprise a single container with a piston pump and hand-carried wand. However, these sprayers are typically one or two gallons in size and are meant for simply maintaining a lawn or garden. The carpet cleaning, lawn and landscape industry demand more efficient commercial-grade sprayers for multiple and larger jobs. Backpack sprayers have become standard equipment in most commercial operations but are limited by the amount and force of the spray. This new system of special volume control manifold, containment case and easily changeable solution containers for carpet cleaning and other solution needs address this shortcoming.

Previous attempts to solve this problem include devices that allow for multiple end-use products to be dispensed through a single valve. For example, one U.S. Pat. No. 3,298,611 was issued to Marraffino et al in 1967 entitled "Spray Head with Rotatable Selector. Another U.S. Pat. No. 4,595,127 was issued to Stoody in 1986 entitled "Self-contained fluid pump aerosol dispenser". These two disclose variations of an aerosol can delivery system that selectively allows one of multiple fluids to be dispensed through a single spray nozzle. Disadvantages of this technology are that multiple end-use products are dispensed through a single nozzle and there is potential for cross-contamination as the user switches between products. Also, including multiple products in a single container will either increase the size and weight of the dispensing container with each end-use product included or the volume of each product will be reduced, resulting in more frequent refills or replacements of the dispensing container. These limitations are corrected by the present disclosure by Davey which includes the multi-venturi controls on each sources for the solvents included.

Another approach is found in U.S. Pat. No. 4,988,017 issued to Schrader, et al in 1991 and entitled "Dual chamber aerosol container". This discloses an aerosol container system with two separated chambers, containing liquids to be mixed just prior to use. A second approach described in prior art is to continuously combine two or more components into a continuous stream, while maintaining fixed relative proportions. U.S. Pat. No. 4,440,314 issued Vetter et al. in 1984—entitled "Method and apparatus for the automatic dynamic dosing at least of one fluid component of a mixed fluid" and U.S. Pat. No. 4,176,672 issued Borberg in 1979 entitled "Mixing apparatus for a first liquid component with at least one additional component" both teach this approach through the use of controllers, flow transducers, and servo controlled pumps. A similar approach is taught by U.S. Pat. No. 4,019,653 issued Scherer, et al in 1977 and is entitled "Automatic proportioning paint spray system". This teaches actuated valves instead of servo controlled pumps to regulate component flow.

While these prior art devices are useful to a degree, they still suffer from certain drawbacks in that they do not provide sufficient durability and reliability without materially adding to the cost or weight of the device.

SUMMARY OF THE INVENTION

This invention is a system of special volume control manifold, containment case and easily changeable solution containers for carpet cleaning and other solution needs. Taught here are the ways a commercial system can be connected through a precisely controlled manifold to have a convenient and portable system for multiple chemical and solution additives to be introduced efficiently at the sprayer wand.

The preferred embodiment of the proportional flow control system of a special volume control manifold, a portable containment case and multiple, changeable and additive solution containers for carpet cleaning and other solution needs comprised of: (a) the control manifold with a continuous, single diameter channel leading to an intake orifice for each of the multiple solution containers, the channel further comprised with a means for removably attaching to an intake hose for transferring a pressured diluent to the manifold at one side and with a means for removably attaching to an output mixed solution hose for transferring a pressured diluent to the manifold at an opposite side; (b) a hose to each of the solution containers; (c) an on/off or variable control valve for each solution container inter placed between the solution container and the manifold intake orifice; (d) a wand with a control valve, a nozzle and a means to connect an mixed solution hose; and (e) the mixed solution hose removably secured between the wand and the manifold wherein the system can be attached to a pressured diluent source and the multiple additive solution containers and provide controlled mixing of the diluent and additive solution at the manifold to create a mixed solution which is then transferred to the sprayer wand. Further the container/carrier The newly invented system of special volume control manifold, containment case and easily changeable solution containers for carpet cleaning and other solution needs may be manufactured at low volumes by very simple means and in high volume production by more complex and controlled systems.

OBJECTS AND ADVANTAGES

There are several objects and advantages of the system of special volume control manifold, containment case and easily changeable solution containers for carpet cleaning and other solution needs. There are currently no known mixing and sprayer systems and devices that are effective at providing the objects of this invention. The system of special volume control manifold, containment case and easily changeable solution containers for carpet cleaning and other solution needs:

| Item | Advantages |
|---|---|
| 1 | is compact in size |
| 2 | is portable |
| 3 | is lightweight |
| 4 | is universal adaptability to other spray systems with mixed solutions |
| 5 | can be made with readily available processes and materials |
| 6 | is non-electric |
| 7 | is reliable |
| 8 | can be manufactured at relatively low costs |
| 9 | is easy to use |
| 10 | is compatible to pressurized water and diluent systems currently in use throughout industry |
| 11 | leaves no residue or mixing of additives in the pressurized hose or sprayer system upon changeover, thereby reducing or eliminating risk of cross-contamination |
| 12 | Eliminates the need for bulk handling and pouring of potentially toxic chemicals |
| 13 | Allows the ability to purchase and store only small amounts of products with resulting economic and safety benefits |
| 14 | Permits the ability to dispose of the package after use, greatly facilitating cleanup, and significantly reducing the use of cleaning solvents, with resulting environmental benefits |
| 15 | Includes multi-venturi controls on each sources for the solvents included |

Finally, other advantages and additional features of the present system of special volume control manifold, containment case and easily changeable solution containers for carpet cleaning and other solution needs will be more apparent from the accompanying drawings and from the full description of the device. For one skilled in the art of controlled solution mixing devices and systems, it is readily understood that the features shown in the examples with this product are readily adapted to other types of solution mixing control and devices.

DESCRIPTION OF THE DRAWINGS

Figures

The accompanying drawings, which are incorporated in and constitute a part of this specification, illustrate an embodiment of the system of special volume control manifold, containment case and easily changeable solution containers for carpet cleaning and other solution needs that is preferred. The drawings together with the summary description given above and a detailed description given below serve to explain the principles of the system of special volume control manifold, containment case and easily changeable solution containers for carpet cleaning and other solution needs. It is understood, however, that the system is not limited to only the precise arrangements and instrumentalities shown.

FIGS. 1 A through 1 D are sketches of the system of special containment case, manifold and easily changeable solution containers for carpet cleaning and other solution needs.

FIGS. 4 B and 4 C are sketches of a venturi pipe system for reference.

FIGS. 7 A through 7 F are sketches showing the system of special containment case, manifold and easily changeable solution containers for carpet cleaning and other solution needs in actual operation.

FIGS. 8 A through 8 C are sketches showing the alternative molded carrier case and solution bottles.

DESCRIPTION OF THE DRAWINGS

Reference Numerals

Figure 2C:
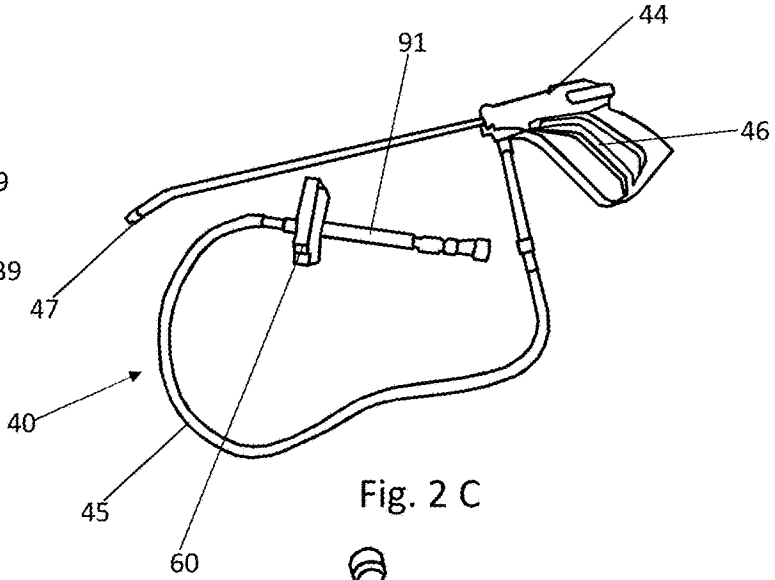
FIGS. 2 A through 2 D are sketches of the header base and wand system connected through the header of the system of special containment case, manifold and easily changeable solution containers for carpet cleaning and other solution needs.
Figure 2B:
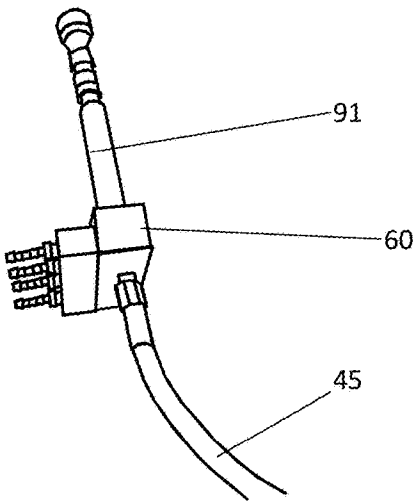
Figure 2D:
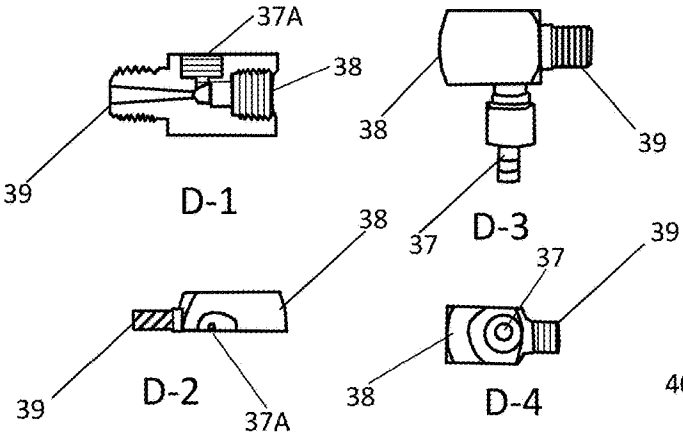
Figure 2A:
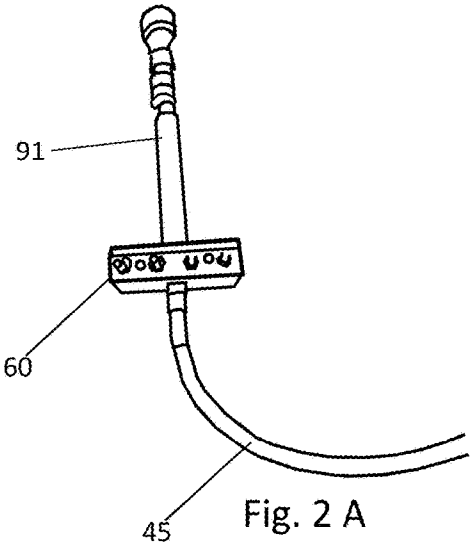

The following list refers to the drawings:

TABLE B

| Reference numbers | |
|---|---|
| Ref # | Description |
| 30 | proportional control system 30 of special containment case, manifold and easily changeable solution containers for carpet cleaning and other solution needs |
| 31 | prototype system 31 of the special containment case, manifold and easily changeable solution containers for carpet cleaning and other solution needs |
| 35 | venturi principle sketch 35 |
| 36 | single container with venturi system connector 36 |
| 37 | inlet hose barb 37 or equal (removable securing system such as barb, crimping, steel or plastic or composite band, threaded fastener configurations, etc.) |
| 37A | inlet barb aperture 37A |
| 38 | source aperture/connection point 38 |
| 39 | outlet aperture/connection point 39 |
| 40 | header and wand components 40 |
| 43 | wand to header means to removably connect/projection 43 or equal (removable securing system such as barb, crimping, steel or plastic or composite band, threaded configuration, etc.) |
| 44 | sprayer wand 44 |
| 45 | wand hose 45 or equal |
| 46 | wand valve 46 |
| 47 | sprayer wand nozzle 47 |

TABLE B-continued

| Reference numbers | |
|---|---|
| Ref # | Description |
| 50 | header to source aperture 50 |
| 51 | header base 51 |
| 51A | alternative header base 51A |
| 51B | back surface 51B of header base 51 |
| 51E | end surface 51E of header base 51 |
| 51T | top surface 51T of header base 51 |
| 5152I | interface 5152I of top surface 51T of header base 51 and bottom surface 52L of carriage 52 |
| 52 | solution inlet carriage 52 |
| 52A | alternative solution inlet carriage 52A |
| 52B | back surface 52B of carriage 52 |
| 52E | end surface 52E of carriage 52 |
| 52T | top surface 52T of carriage 52 |
| 52U | bottom or under surface 52U of carriage 52 |
| 53 | solution means to connect 53 hose barb, fitting or equal (removable securing system such as barb, crimping, steel or plastic or composite band, threaded fastener configurations, etc.) |
| 53A | aperture 53A in carriage 52 for means to connect 53 |
| 53B | optional quick-connect solution means to connect 53A hose barb, fitting or equal |
| 54 | equal diameter pitot channel and orifice 54 |
| 54A | pitot/channel flange 54A |
| 55 | pitot/channel plugs 55 |
| 56 | aperture of means to attach 57 carriage 52 to header base 51 |
| 57 | means 57 for attaching carriage 52 to header base 51 (such as threaded fasteners) |
| 58 | ball stop 58 |
| 59 | ball seal 59 |
| 60 | header prototype 60 |
| 61 | header drawings 61 |
| 62 | header/manifold 62 |
| 63 | solvent reservoir 63 (container, bottle, can, or equal vessel) |
| 64 | solvent control valves 64 |
| 65 | solvent hoses 65 or equal to carriage barbs 53 |
| 66 | solvent reservoir carrier/container 66 |
| 66A | alternative solvent reservoir carrier/container 66A |
| 90 | pressure source and mixer base 90 |
| 91 | input water 91 or base material |
| 92 | feeder hose 92 |
| 93 | source main valve 93 |
| 94 | pump/pressure source 94 for main base 91 |
| 95 | base mixer 95 - vat/vessel/pressured process hose, etc. |
| 96 | truck, trailer or vehicle with pump and base mix solution control 96 |
| 100 | operator 100 |

DETAILED DESCRIPTION OF PREFERRED EMBODIMENT

The present development is a proportional controlled system of special volume control manifold, containment case and easily changeable solution containers for carpet cleaning and other solution needs. This invention relates to a portable system of special volume control manifold, containment case and easily changeable solution containers for carpet cleaning and other solution needs. This system relates particularly to portable commercial-grade mixer and sprayers and, more particularly, to a portable multi-pack additive and solutions for spraying through a hand-carried spray wand any of a variety of different chemicals and additives from modular containers seated in a portable container.

Taught here are the ways a commercial system can be connected through a precisely controlled manifold to have a convenient and portable system for multiple chemical and solution additives to be introduced efficiently at the sprayer wand. The system is connected directly to a pressure system with a base or diluent such as water (or other solutions, paints, etc.). The additives are controlled at a manifold header for precisely controlled dispersal to the sprayer wand and nozzle.

The advantages for the System of special volume control manifold, containment case and easily changeable solution containers for carpet cleaning and other solution needs 30 are listed above in the introduction. Succinctly the benefits are that the device:

A. is compact in size
B. is portable
C. is lightweight
D. is universal adaptability to other spray systems with mixed solutions
E. can be made with readily available processes and materials
F. is non-electric
G. is reliable
H. can be manufactured at relatively low costs
I. is easy to use
J. is compatible to pressurized water and diluent systems currently in use throughout industry
K. leaves no residue or mixing of additives in the pressurized hose or sprayer system upon changeover, thereby reducing or eliminating risk of cross-contamination
L. eliminates the need for bulk handling and pouring of potentially toxic chemicals
M. allows the ability to purchase and store only small amounts of products with resulting economic and safety benefits and
N. permits the ability to dispose of the package after use, greatly facilitating cleanup, and significantly reducing the use of cleaning solvents, with resulting environmental benefits
O. is comprised with multi-venturi controls on each sources for the solvents included The preferred embodiment of the proportional flow control system of a special volume control manifold, a portable containment case and multiple, changeable and additive solution containers for carpet cleaning and other solution needs comprised of: (a) the control manifold with a continuous, single diameter channel leading to an intake orifice for each of the multiple solution containers, the channel further comprised with a means for removably attaching to an intake hose for transferring a pressured diluent to the manifold at one side and with a means for removably attaching to an output mixed solution hose for transferring a pressured diluent to the manifold at an opposite side; (b) a hose to each of the solution containers; (c) an on/off or variable control valve for each multi-venturi controls on each sources for the solvents included solution container inter placed between the solution container and the manifold intake orifice; (d) a wand with a control valve, a nozzle and a means to connect an mixed solution hose; and (e) the mixed solution hose removably secured between the wand and the manifold wherein the system can be attached to a pressured diluent source and the multiple additive solution containers and provide controlled mixing of the diluent and additive solution at the manifold to create a mixed solution which is then transferred to the sprayer wand.

There is shown in FIGS. 1-8 a complete description and operative embodiment of the system of special volume control manifold, containment case and easily changeable solution containers for carpet cleaning and other solution needs 30. In the drawings and illustrations, one notes well that the FIGS. 1-7 demonstrate the general configuration and use of this product. The various example uses are in the operation and use section, below.

The accompanying drawings, which are incorporated in and constitute a part of this specification, illustrate an embodiment of the system of special volume control manifold, containment case and easily changeable solution containers for carpet cleaning and other solution needs 30 that is preferred. The drawings together with the summary description given above and a detailed description given below serve to explain the principles of the system of special volume control manifold, containment case and easily changeable solution containers for carpet cleaning and other solution needs 30. It is understood, however, that the system of special volume control manifold, containment case and easily changeable solution containers for carpet cleaning and other solution needs 30 is not limited to only the precise arrangements and instrumentalities shown. Other examples of fluid control and mixing devices for solutions are still understood by one skilled in the art of solution mixing devices to be within the scope and spirit shown here.

FIGS. 1 A through 1 D are sketches of the system 30 of special containment case, manifold and easily changeable solution containers for carpet cleaning and other solution needs. Shown here are the proportional control system 30 of special containment case, manifold and easily changeable solution containers for carpet cleaning and other solution needs; header and wand components 40; header to source aperture 50; and header prototype 60. The components and features of these are described further below.

FIGS. 2 A through 2 D are sketches of the header base and wand system connected through the header of the system of special containment case, manifold and easily changeable solution containers for carpet cleaning and other solution needs. Demonstrated in these sketches are a single container with venturi system connector 36; inlet hose barb 37 or equal such as but not limited to a barb, crimping, steel or plastic or composite band, threaded fastener, etc.; inlet barb aperture 37A; source aperture/connection point 38; outlet aperture/connection point 39; the header and wand components 40; sprayer wand 44; wand hose 45 or equal; wand valve 46; sprayer wand nozzle 47; header prototype 60; and input water 91 diluent or base material all of which may be heated and temperature and pressure controlled.

Figures 3A, 3B, 3C, 3D, 3E, 3F, 3G, 3H, 3I:
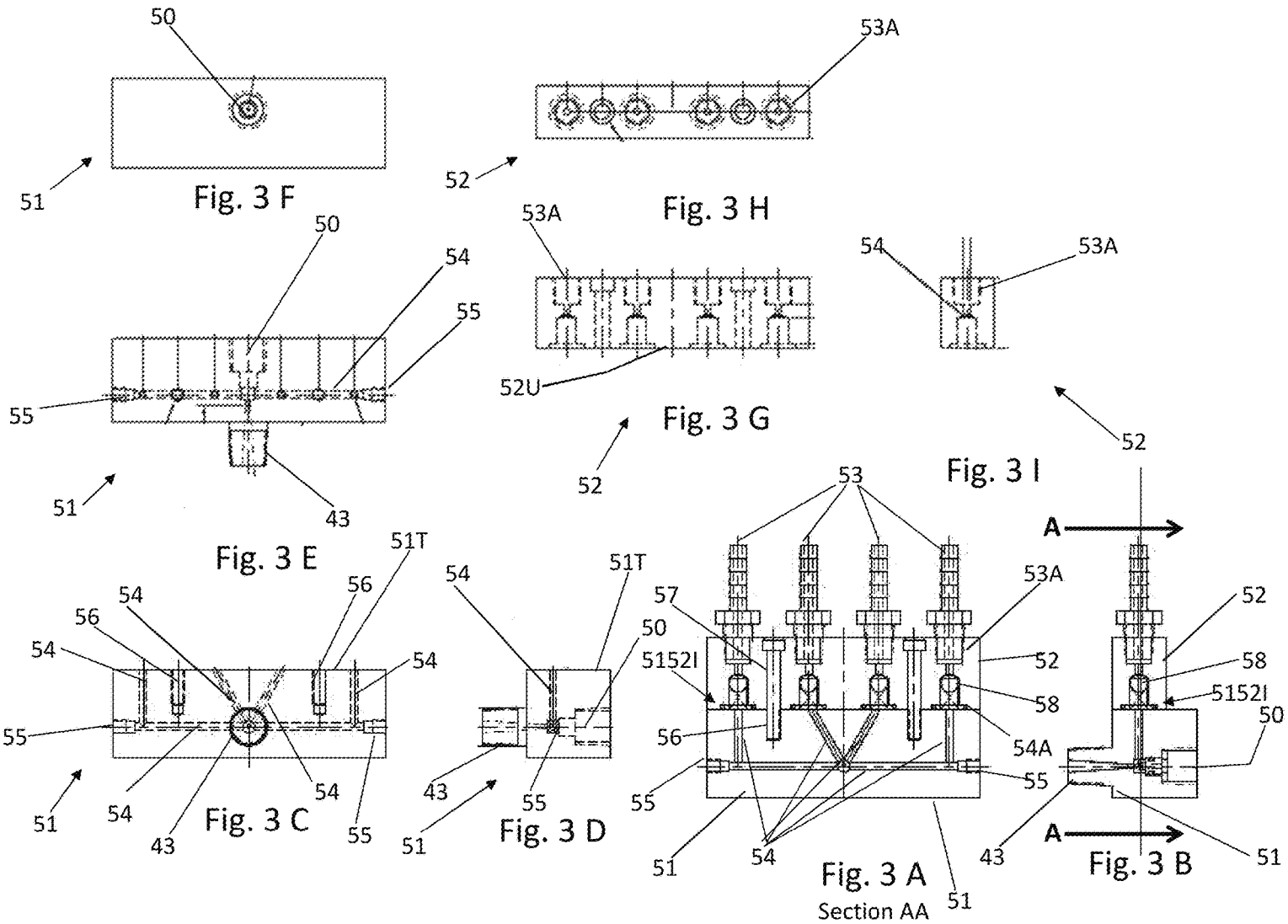
FIGS. 3 A through 3 I are sketches and design drawings of the header base and solution inlet carriage of the system of special containment case, manifold and easily changeable solution containers for carpet cleaning and other solution needs with the components and features shown from several views.

FIGS. 3 A through 3 I are sketches and design drawings of the header base and solution inlet carriage of the system of special containment case, manifold and easily changeable solution containers for carpet cleaning and other solution needs with the components and features shown from several views. The features and components shown in these sketches include: the wand to header means to connect/projection 43; header to source aperture 50; header base 51; top surface 51T of header base 51; interface 5152I of top surface 51T of header base 51 and bottom surface 52L of carriage 52; solution inlet carriage 52; bottom or under surface 52U of carriage 52; solution means to connect 53 hose barb, fitting or equal (removable securing system such as barb, crimping, steel or plastic or composite band, threaded fastener configurations, etc.); aperture 53A in carriage 52 for means to connect 53; equal diameter pitot channel and orifice 54; pitot flange 54A; pitot channel plugs 55; aperture of means to attach 57 carriage 52 to header base 51; means 57 for attaching carriage 52 to header base 51; ball stop 58; and ball seal 59. This manifold may be made of various metals such as steel, brass, copper, stainless steel and other steel alloys. It may also be made of durable plastic or a machinable composite materials. Likely most will be machined, but casting and quality molding may also be used to process this control manifold 62.

Figure 4C:
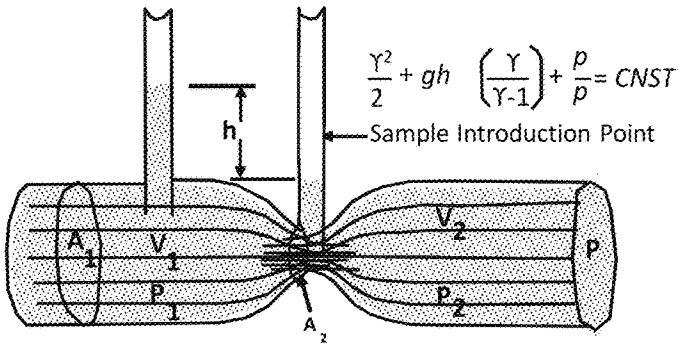
FIG. 4 A is a schematic of the components of the system of special containment case, manifold and easily changeable solution containers for carpet cleaning and other solution needs.
Figure 4B:
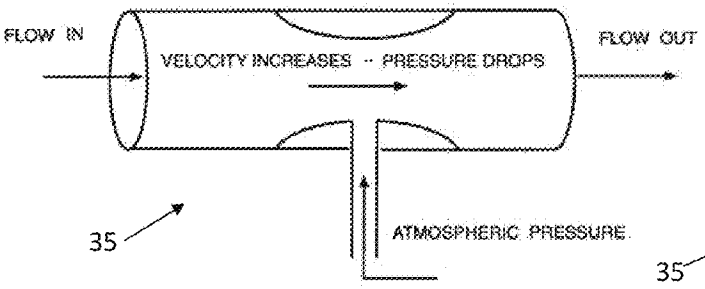
Figure 4A:
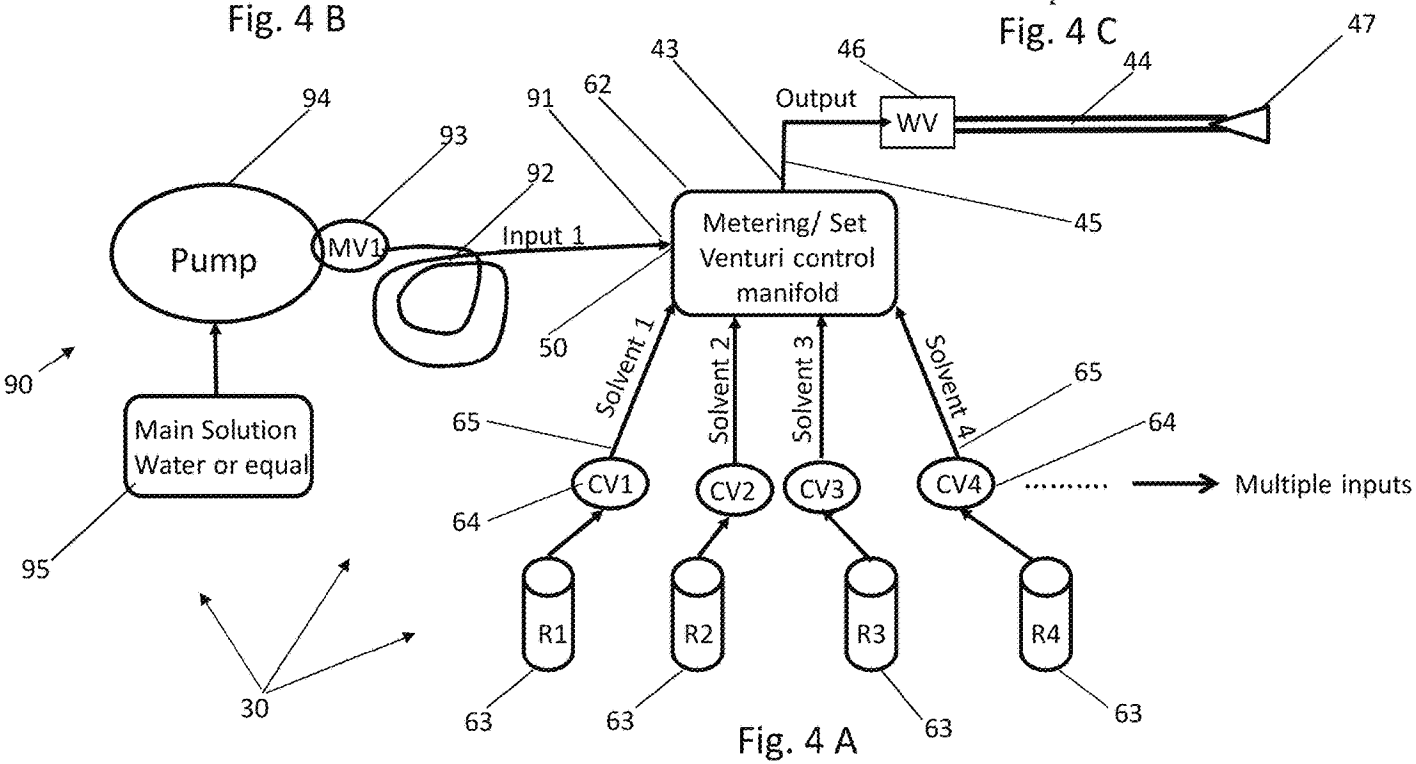

FIG. 4 A is a schematic of the components of the system of special containment case, manifold and easily changeable solution containers for carpet cleaning and other solution needs. FIGS. 4 B and 4 C are sketches of a venturi pipe system for reference. Demonstrated here are the following components and features: proportional control system 30 of special containment case, manifold and easily changeable solution containers for carpet cleaning and other solution needs; venturi principle sketch 35; wand to header means to connect/projection 43; sprayer wand 44; wand hose 45 or equal; wand valve 46; sprayer wand nozzle 47; header to source aperture 50; header/manifold 62; solvent reservoir 63 (container, bottle, can, or equal vessel); solvent control valves 64; solvent hoses 65 or equal to carriage barbs 53 (removable securing system such as barb, crimping, steel or plastic or composite band, threaded fastener configurations, etc.); input water 91 diluent or base material and feeder hose 92; source main valve 93; pump/pressure source 94 for main base 91; and base mixer 95—vat/vessel/pressured process hose, etc.

Figure 5C:
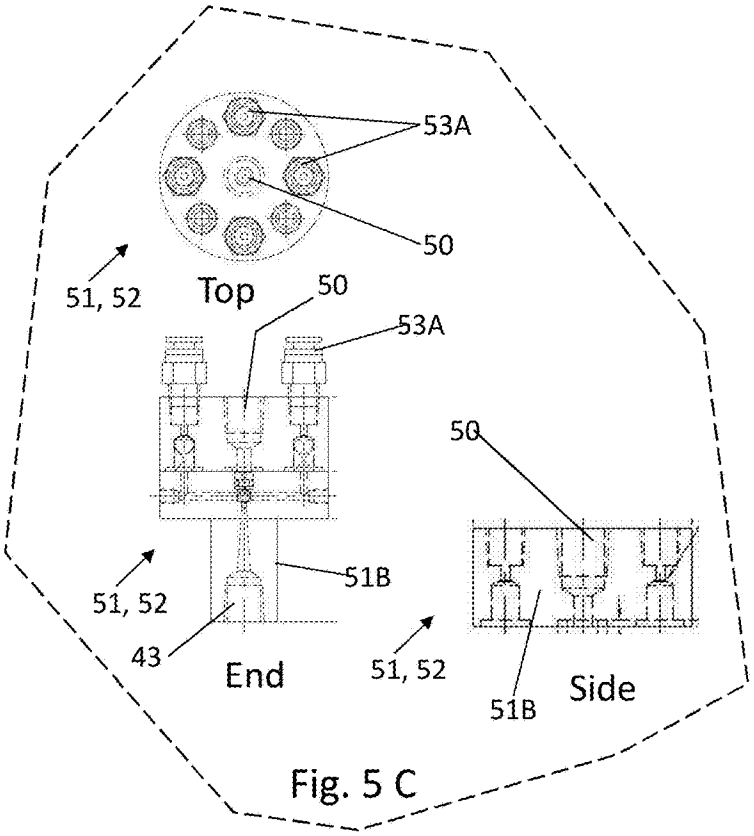
FIGS. 5 A through 5 C are sketches of the header prototypes with the components and features shown from several views.
Figure 5A:
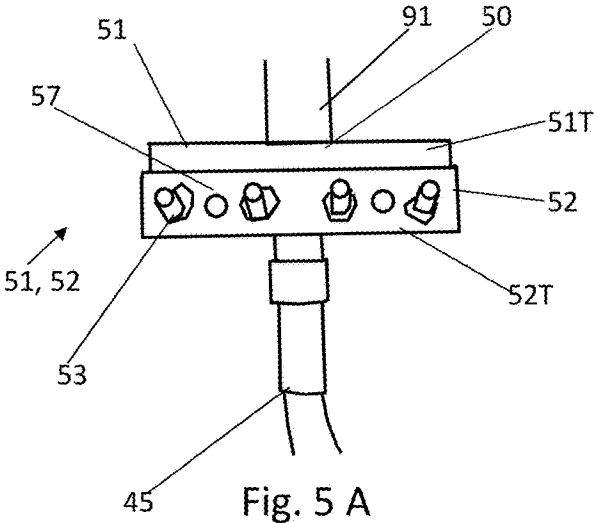
Figure 5B:
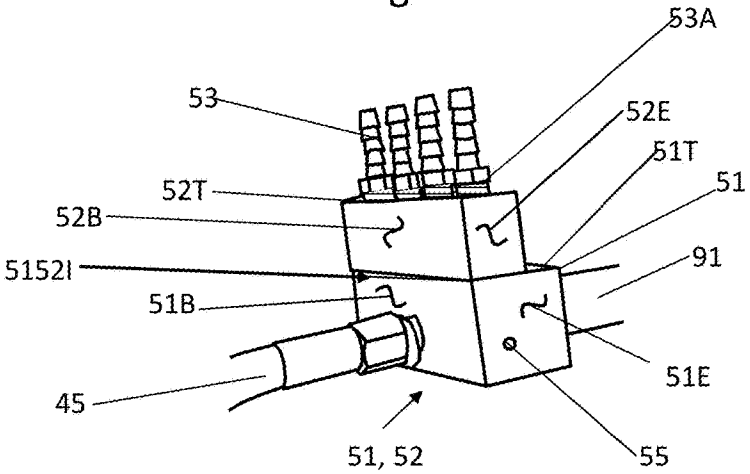

FIGS. 5 A through 5 C are sketches of the header prototypes and alternative sketches with the components and features shown from several views. Components for the proportional control system 30 of special containment case, manifold and easily changeable solution containers for carpet cleaning and other solution needs shown in these figures are: wand hose 45 or equal; header to source aperture 50; header base 51; back surface 51B of header base 51; end surface 51E of header base 51; top surface 51T of header base 51; interface 5152I of top surface 51T of header base 51 and bottom surface 52L of carriage 52; solution inlet carriage 52; back surface 52B of carriage 52; end surface 52E of carriage 52; top surface 52T of carriage 52; solution means to connect 53 hose barb, fitting or equal; aperture 53A in carriage 52 for means to connect 53; means 57 for attaching carriage 52 to header base 51; and input water 91 diluent or base material. FIG. 5 C shows the side, end and top views of the alternative header base 51A and alternative solution inlet carriage 52A. The components and features are similar to those in FIGS. 5 A and 5 B.

Figure 6B:
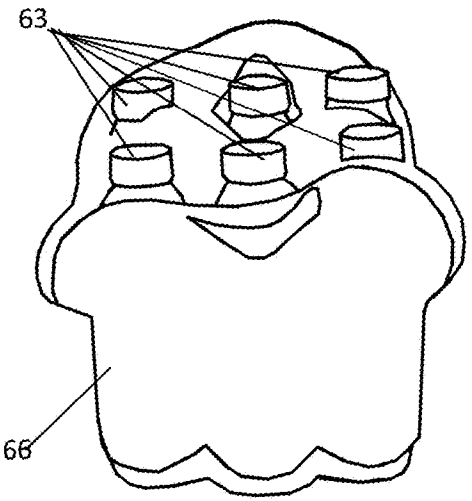
FIGS. 6 A through 6 C are sketches of sample container carriers for example and not as a limitation.
Figure 6C:
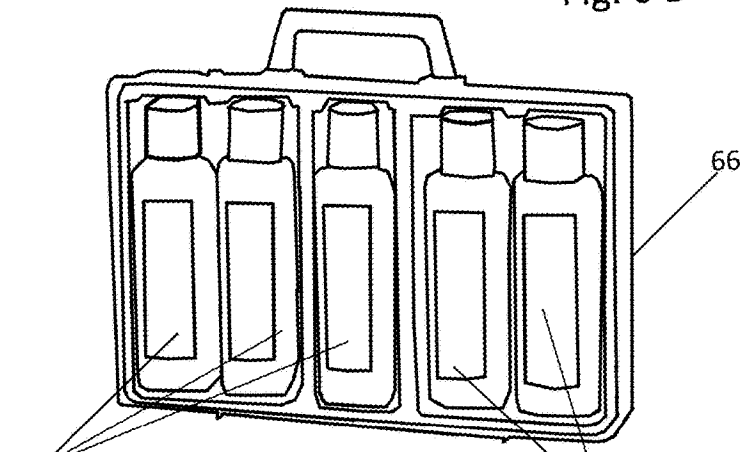
Figure 6A:
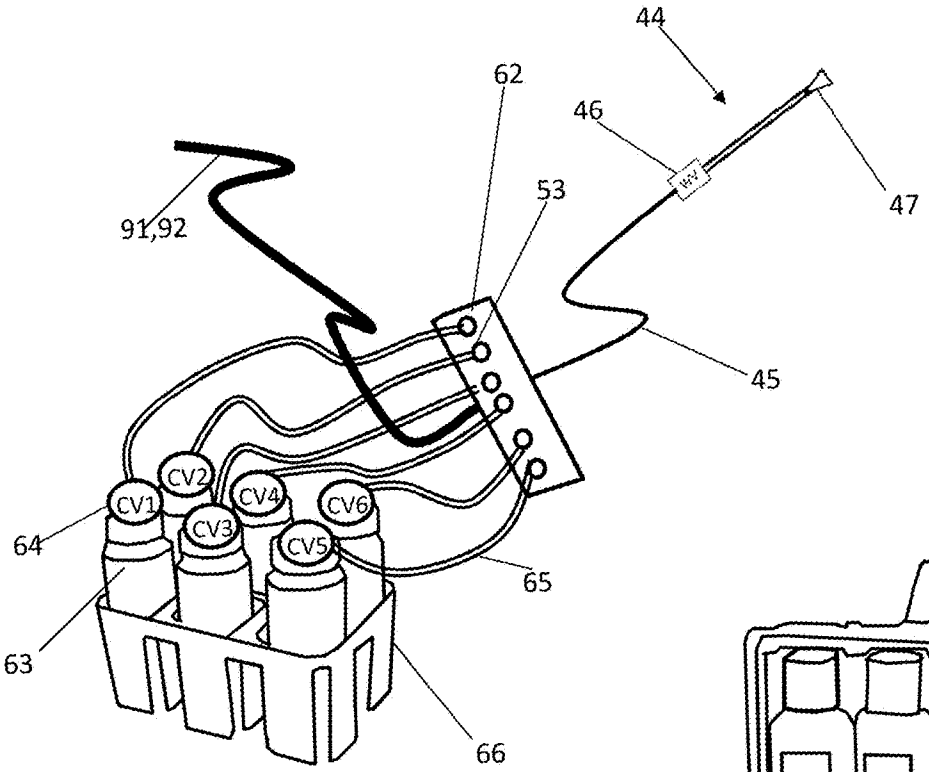

FIGS. 6 A through 6 C are sketches of sample container carriers for example and not as a limitation. Shown in these sketches are: sprayer wand 44; wand hose 45 or equal wand valve 46; sprayer wand nozzle 47; solution means to connect 53 hose barb, fitting or equal; header/manifold 62 solvent reservoir 63 (container, bottle, can, or equal vessel); solvent control valves 64; solvent hoses 65 or equal to carriage barbs 53; solvent reservoir carrier/container 66; input water 91 or base material; and a pressurized feeder hose 92. The case anticipates being made of a durable material such as but not limited to: a composite material, plastic, reinforced plastic, metal, steel, pewter, steel alloy or aluminum.

FIGS. 7 A through 7 F are sketches showing the system of special containment case, manifold and easily changeable solution containers for carpet cleaning and other solution needs in actual operation. This is discussed in the operations section, below.

FIGS. 8 A through 8 C are sketches showing the alternative molded carrier case 66A and solution bottles 63. The components and features are similar to those in FIGS. 6 A through 6 C.

The details mentioned here are exemplary and not limiting. Other specific components and manners specific to describing a system of special volume control manifold, containment case and easily changeable solution containers for carpet cleaning and other solution needs 30 may be added as a person having ordinary skill in the field of solution mixing systems and devices and their uses well appreciates.

OPERATION OF THE PREFERRED EMBODIMENT

The system of special volume control manifold, containment case and easily changeable solution containers for carpet cleaning and other solution needs 30 has been described in the above embodiment. The manner of how the device operates is described below. One notes well that the description above and the operation described here must be taken together to fully illustrate the concept of the system of special volume control manifold, containment case and easily changeable solution containers for carpet cleaning and other solution needs 30. The preferred embodiment of the proportional flow control system 30 of a special volume control manifold, a portable containment case and multiple, changeable and additive solution containers with multi-venturi controls on each sources for the solvents included to be used for carpet cleaning and other solution needs comprised of: (a) the control manifold with a continuous, single diameter channel leading to an intake orifice for each of the multiple solution containers, the channel further comprised with a means for removably attaching to an intake hose for transferring a pressured diluent to the manifold at one side and with a means for removably attaching to an output mixed solution hose for transferring a pressured diluent to the manifold at an opposite side; (b) a hose to each of the solution containers; (c) an on/off or variable control valve for each solution container inter placed between the solution container and the manifold intake orifice; (d) a wand with a control valve, a nozzle and a means to connect an mixed solution hose; and (e) the mixed solution hose removably secured between the wand and the manifold wherein the system can be attached to a pressured diluent source and the multiple additive solution containers and provide controlled mixing of the diluent and additive solution at the manifold to create a mixed solution which is then transferred to the sprayer wand.

Once the system of special volume control manifold, containment case and easily changeable solution containers for carpet cleaning and other solution needs 30 is assembled as shown and described above, the operator uses the system. The operator 100 adjusts and controls various control valves 64 to permit additive solvent to enter from the reservoir 63 to the header 62. The additive solvent is pulled through the pitot channel 54, the additive then mixes with the water or diluent 95 and creates the mixture. If another additive is desired, the operator closes the control valve 64 for the "unwanted additive" reservoir 63 and opens the other desired control valve 64 to the "wanted additive". No residue is in the line and the main hose 92 is free of unwanted mixed fluid. If needed, the small amount in the wand may be flushed out with all control valves 64 closed. The portable containers 63 may be easily changed or refilled and maintained in the portable container case 66 with the operator 100.

Many uses are anticipated for the system of special volume control manifold, containment case and easily changeable solution containers for carpet cleaning and other solution needs 30. Some examples, and not limitations, are shown in the following Table.

| Item | Use |
|---|---|
| 1 | carpet and floor cleaning systems |
| 2 | chemical pest control |
| 3 | weed control |

-continued

| Item | Use |
|---|---|
| 4 | flower and vegetable nutrient spray |
| 5 | paint and stain mix control |
| 6 | lawn care systems |
| 7 | car wash cleaners |

FIGS. 7 A through 7 F are sketches showing the system of special containment case, manifold and easily changeable solution containers for carpet cleaning and other solution needs in actual operation. Here is shown the proportional control system 30 of special containment case, manifold and easily changeable solution containers for carpet cleaning and other solution needs. In action, the operator 100 adjusting and controlling various control valves 64 to permit additive solvent to enter from the reservoir 63 to the header 62. Also shown are: sprayer wand 44; header/manifold 62; solvent reservoir 63 (container, bottle, can, or equal vessel); solvent control valves 64; pressure source and mixer base 90; input water 91 or base material; feeder hose 92; and truck, trailer or vehicle with pump and base mix solution control 96.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

With this description it is to be understood that the system of special volume control manifold, containment case and easily changeable solution containers for carpet cleaning and other solution needs 30 is not to be limited to only the disclosed embodiment of product. The features of the system of special volume control manifold, containment case and easily changeable solution containers for carpet cleaning and other solution needs 30 are intended to cover various modifications and equivalent arrangements included within the spirit and scope of the description.

What is claimed is:

1. A portable and non-electric proportional flow control system for carpet cleaning and for other uses needing mixed solutions comprised of:

a control manifold contiguous to and directly connected to multiple solution containers, further comprising a pressurized water source aperture and a connection aperture for a single hose for dispersing a mixed solution;

a hose individually connected to each of the multiple solution containers;

an individual control valve on each of the multiple containers as a liquid control valve using a venturi action as a means for controlling liquid dispersed from each of the multiple solution containers;

a sprayer wand with a secondary control valve, a nozzle and a means for connecting to a hose for dispersing a mixed solution;

the single hose for dispersing the mixed solution between the sprayer wand and the connection aperture for a mixed solution hose of the manifold; and a source hose for a pressurized water, the source hose being removably secured to the pressurized water source aperture of the control manifold wherein the system can be attached at the control manifold to a source hose for a pressurized water, the source hose being removably secured to the pressurized water source intake of the control manifold and the multiple additive solution containers and provide controlled mixing of the pressurized water and a controlled amount of additive solution within the manifold to create a mixed solution which is then transferred to the sprayer wand.

2. The device according to claim 1 Further comprised of a container/carrier made of a durable material capable of holding caustic and acidic solutions.

3. The device according to claim 2 wherein the durable material is selected from the group consisting of a composite material, a plastic, a reinforced plastic, a metal, a steel, a pewter, a steel alloy and an aluminum.

4. The device according to claim 1 wherein the use is selected from the group consisting of carpet and floor cleaning systems, chemical pest control systems, weed control systems, flower and vegetable nutrient spray systems, paint and stain mix control systems, lawn care systems, and car wash cleaners and systems.

5. A non-electric proportional flow control system for carpet cleaning and other uses needing mixed solutions comprised of:

(a) a control manifold contiguous to and directly connected to multiple solution containers, the control manifold with a continuous, single diameter channel leading from a pressurized water source aperture, continuing past a series of intake orifices for each of the multiple solution containers, and a connection aperture for a mixed solution hose;

(b) a set of hoses individually connected to each of the multiple solution containers;

(c) an individual on/off control valve for each of the multiple solution containers inter placed between the solution container and the manifold intake orifice that includes a control valve on each source for a solvent, the control valve using a venturi action as a means for controlling liquid dispersed;

(d) a sprayer wand with a secondary on/off control valve, a nozzle and a means to connect a mixed solution hose;

(e) the mixed solution hose removably secured between the sprayer wand and the manifold; and (f) a source hose for a pressurized water, the source hose being removably secured to the pressurized water source aperture of the control manifold wherein the system can be attached at the control manifold to a pressured water source and to the multiple additive at each of the multiple solution containers and provide controlled mixing of a diluent and a controlled amount of additive solution within the manifold to create a mixed solution which is then transferred to the sprayer wand.

6. The device according to claim 5 wherein the solution container control valve is controlled for a variable output dispersal of the mixed solution.

7. The device according to claim 5 wherein the means to connect the mixed solution hose is selected from the group consisting of a barb, crimping, steel or plastic or composite band, threaded fastener.

8. The device according to claim 5 Further comprised of a container/carrier made of a durable material.

9. The device according to claim 8 wherein the durable material is selected from the group consisting of a composite material, a plastic, a reinforced plastic, a metal, a steel, a pewter, a steel alloy and an aluminum.

10. The device according to claim 5 wherein the use is selected from the group consisting of carpet and floor cleaning systems, chemical pest control systems, weed control systems, flower and vegetable nutrient spray systems, paint and stain mix control systems, lawn care systems, and car wash cleaners and systems.

11. A non-electric proportional flow control system of a special volume control manifold, a portable containment case and multiple, changeable and additive solution containers for carpet cleaning and other uses needing mixed solutions comprised of:

(a) the control manifold contiguous to and directly connected to each of the multiple solution containers with a continuous, single diameter channel leading to an intake orifice for each of the multiple solution containers, the channel further comprised with a connection fastening means for removably attaching to an intake pressurized water source hose for transferring a pressured diluent to the manifold at one side and with a connection fastening means for removably attaching to an output of the mixed solution hose for transferring a pressured diluent to the manifold at an opposite side;

(b) a hose individually connected to each of the multiple solution containers;

(c) an individual on/off or variable control valve for each of the multiple solution containers inter placed between the multiple solution containers and the manifold intake orifice and the control valve using a venturi action to pull a quantity of solution from the solution container into the manifold intake orifice;

(d) a sprayer wand with a secondary control valve, a nozzle and a means to connecting to a hose or dispersing a mixed solution; and (e) the output mixed solution hose removably secured between the sprayer wand and the manifold wherein the system can be attached at the control manifold to a source hose for a pressurized water, the source hose being removably secured to the pressurized water source intake of the control manifold and the multiple additive solution containers and provide controlled mixing of the pressurized water and a controlled amount of additive solution within the manifold to create a mixed solution which is then transferred to the sprayer wand.

12. The device according to claim 11 wherein the means to connect a mixed solution hose is selected from the group consisting of a barb, crimping, steel or plastic or composite band, threaded fastener.

13. The device according to claim 11 wherein the solution container control valve is variable.

14. The device according to claim 11 further comprised of a container/carrier made of a durable material.

15. The device according to claim 11 wherein the durable material is selected from the group consisting of a composite material, a plastic, a reinforced plastic, a metal, a steel, a pewter, a steel alloy and an aluminum.

16. The device according to claim 11 wherein the use is selected from the group consisting of carpet and floor cleaning systems, chemical pest control systems, weed control systems, flower and vegetable nutrient spray systems, paint and stain mix control systems, lawn care systems, and car wash cleaners and systems.

* * * * *